United States Patent [19]

Sell

[11] 4,381,180

[45] Apr. 26, 1983

[54] DOUBLE DIAPHRAGM PUMP WITH CONTROLLING SLIDE VALVE AND ADJUSTABLE STROKE

[76] Inventor: John R. Sell, 1633 Marconi Rd., Wall, N.J. 07719

[21] Appl. No.: 282,933

[22] Filed: Jul. 13, 1981

[51] Int. Cl.[3] ..... F04B 17/00

[52] U.S. Cl. ..... 417/393; 91/306; 137/625.27

[58] Field of Search ..... 417/393; 91/304, 305, 91/306, 313; 137/625.27, 625.6

[56] References Cited

U.S. PATENT DOCUMENTS

| | | | |
|---|---|---|---|
| 2,606,739 | 8/1952 | Gardner | 137/625.27 X |
| 2,645,451 | 7/1953 | Gladden | 137/625.27 X |
| 3,348,803 | 10/1967 | Churchill, Jr. | 91/313 X |
| 3,540,348 | 11/1970 | Pennther | 91/306 |
| 3,555,966 | 1/1971 | Coniglio | 91/306 |
| 3,811,795 | 5/1974 | Olsen | 91/306 |
| 3,838,946 | 10/1974 | Schall | 417/395 |
| 3,860,034 | 1/1975 | Rupp | 137/625.25 |
| 4,104,008 | 8/1978 | Hoffmann et al. | 91/306 X |
| 4,161,308 | 7/1979 | Bell et al. | 91/306 X |

*Primary Examiner*—Leonard E. Smith

*Attorney, Agent, or Firm*—Ralph R. Roberts

[57] ABSTRACT

This invention provides a double-acting, double diaphragm pump particularly for fluids such as chemical compounds. The pump employs adjustable disk members mounted on a reciprocable rod connecting and actuating the diaphragms. These disks alternately engage the extending shaft of a pilot valve to move the valve and redirect the flow of pressurized fluid therethrough. The pressurized fluid behind the diaphragm is now caused to flow to a slide valve and cause it to be moved to an opposite limit. The slide valve is cycled by the pilot valves as the disks on the reciprocated rod engage the pilot valves. Each pump half has the exterior wall member disposed to carry two one-way valves, one valve to inhibit inward flow to the chamber and one valve to inhibit flow from the chamber.

22 Claims, 11 Drawing Figures

DOUBLE DIAPHRAGM PUMP WITH CONTROLLING SLIDE VALVE AND ADJUSTABLE STROKE

BACKGROUND OF THE INVENTION

DESCRIPTION OF THE PRIOR ART

A pre-Ex search of the art was made since double diaphragm pumps are well known. The use of diaphragms to pump fluids, particularly chemicals, is also well known. Slide valve control of the pump actuation is also known as evidenced by U.S. Pat. No. 3,838,946 to Schall as issued on Oct. 1, 1974. Also to be noted in particular in U.S. Pat. No. 3,860,034 to Rupp as issued Jan. 14, 1975.

In the present apparatus is provided a double diaphragm pump in which the diaphragms are actuated by a single shaft or rod. A slide valve is actuated by pressurized fluid which includes gas, air, oil or water and as air is one of the least expensive of these "air" is used to define any and all. This slide valve is moved to selectively admit pressurized air to a valve which passes the pressurized air to one side of the diaphragm to provide one-half the stroke. The shaft also moves the other diaphragm and disks attached to the shaft. This movement of the attached disks controls the effective pump stroke in each diaphragm chamber.

Slide valve control of double diaphragm pumps and single shafts that connect the two diaphragms are shown in prior art patents. The present invention provides a simple dual diaphragm pump with a pilot valve actuated by and with the movement of the shaft and disks carried thereon. These disks can and may be adjusted to vary the pumping action from the chambers. Pressurized air is contemplated for actuating the pump. The adjusting of the stroke actuation so that one chamber may pump one volume of fluid and the other diaphragm chamber pump another volume is provided by the present apparatus.

SUMMARY OF THE INVENTION

This invention may be summarized, at least in part, with reference to its objects. It is an object of this invention to provide, and it does provide, a slide valve disposed to supply pressurized air alternately to a dual diaphragm pump. The pressurized air is fed to the diaphragms by a reciprocated valve that is cycled in response to actuation of the diaphragms and actuating disks carried on a common piston rod extending between the diaphragms.

It is a further object of this invention to provide, and it does provide, a dual diaphragm pump which is actuated by pressurized air metered by a slide valve. This slide valve is moved in response to the actuation of control valves moved by adjusted disks secured to a common rod extending between and carrying the mid-portion of the diaphragms.

It is a further object of this invention to provide, and it does provide, a high capacity double-acting and dual chambered diaphragm pump with a common and connecting shaft actuating each of the diaphragms. The common shaft, as it is cycled back and forth, insures that a pumping stroke occurs while a suction stroke is produced by the other actuated diaphragm. The pressurized air and control valves insure that as a pumping stroke is made a return or suction stroke is made with and by the other diaphragm chamber.

In brief, the apparatus disclosed shows a double diaphragm pump in which the control valves are positive acting and are readily accessable for repair and adjustment. The diaphragms are made of flexible material with their central portions reinforced by disk means and the diaphragms are connected and actuated by a common shaft. Each diaphragm divides a chamber formed of two halves. The outer housing cover of each chamber has two one-way valves that are arranged so as to admit fluid to be pumped and to provide a different exit conduit for the fluid drawn into the chamber with the suction stroke. These one-way valves are arranged to suit the installation for which the pump is to be used. A central housing is provided and at each end is secured the diaphragm chambers. A reciprocable shaft is carried in this housing and valve means control the length and rapidity of stroke. The diaphragms have their central portion reinforced so that the diaphragm is not unduly weakened by and with use. The connecting shaft is longitudinally carried in bearings and seals so the interior chamber is actuated and moved by pressurized air. The spool or power valve is easily removable from the housing and the pilot valves are easily replaced or repaired. Novelty of this diaphragm pump lies in the spool valve and the pilot valves and the actuating of these valves by cycled disks.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of double diaphragm pump with a controlling slide valve and an adjustable stroke as adopted for use for pumping fluids and showing a preferred means of construction. The specific embodiment has been chosen for the purposes of illustration and description as shown in the accompanying drawings wherein:

BRIEF DESCRIPTION OF THE DRAWINGS

In the following description and in the claims various details are identified by specific names for convenience. These names are intended to be generic in their application. Corresponding reference characters refer to like members throughout the several figures of the drawings.

EMBODIMENT OF FIGS. 1 AND 2

Figure 1:
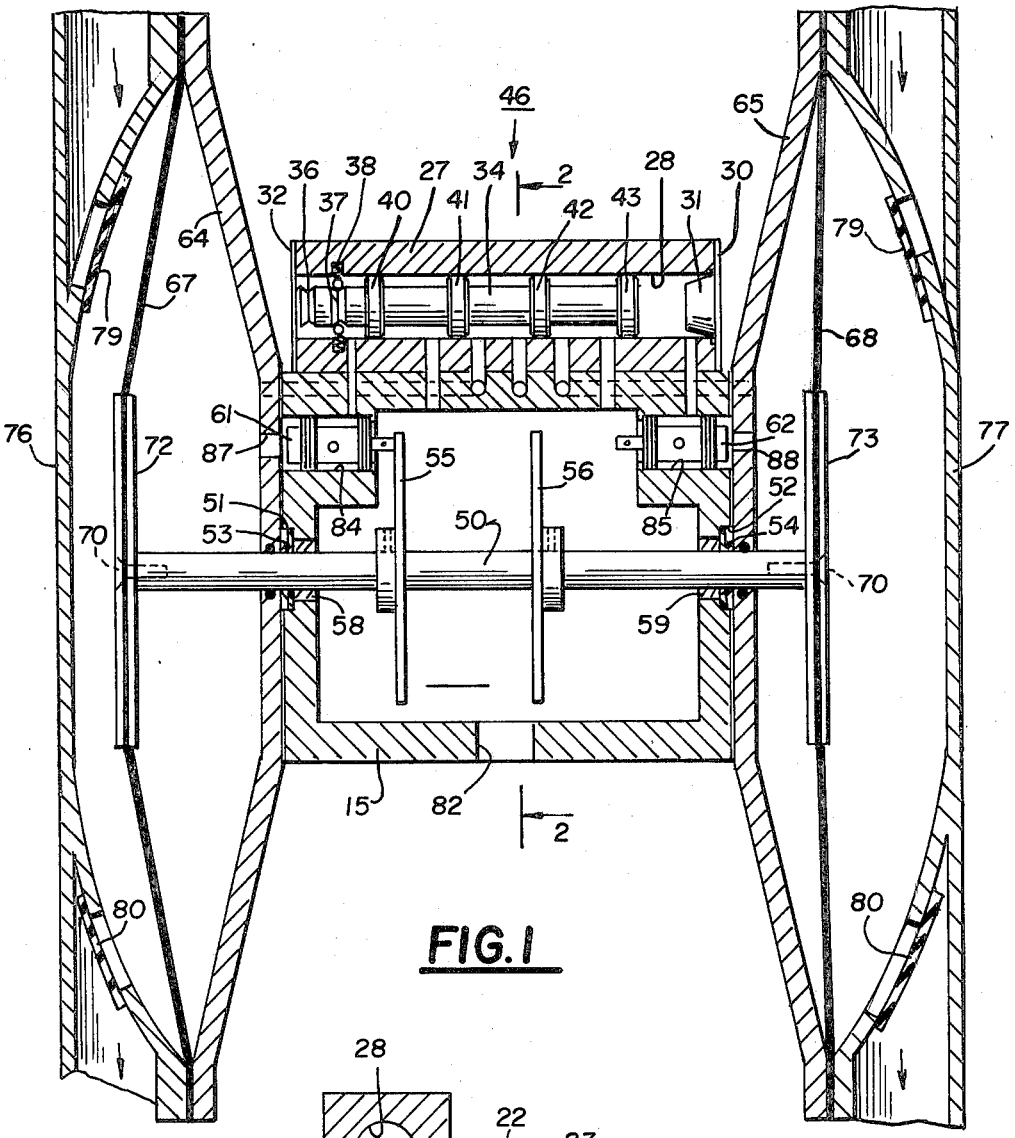
FIG. 1 represents a sectional front view, partly diagrammatic, and showing a preferred arrangement of the several components that provide the assembly of a dual diaphragm pump.
Figure 2:
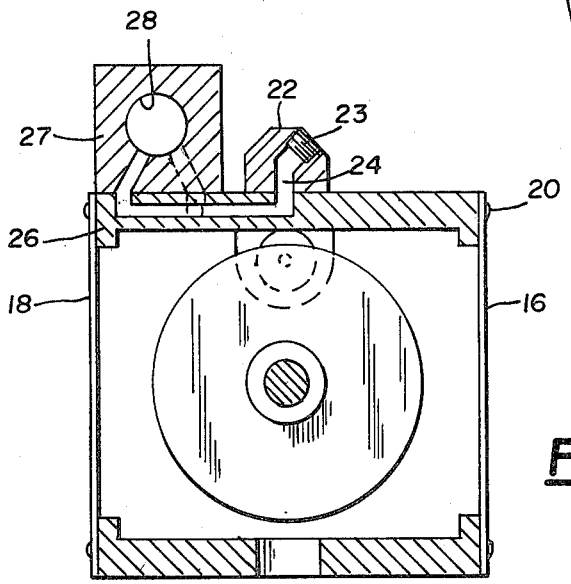
FIG. 2 represents a transverse sectional view of the central body member, an inlet and a sliding spindle and housing, said spindle absent a diaphragm housing, this view taken on the line 2—2 of FIG. 1 and looking in the direction of the arrows.

Referring next and now to the drawings and in particular to FIGS. 1 and 2, it is to be noted that a double diaphragm pump is shown and includes a main housing 15. As seen in FIG. 2 this housing includes front and back access covers 16 and 18 that are retained in place as by round head cap screws 20. Alternate securing means may be used if desired. Also seen in FIG. 2 and attached to housing 15 is a central inlet member 22 with an inlet 23 formed therein. This inlet member is secured to the top of the housing 15 and provides an air passageway 24 which mates with a transverse passageway 25 formed in the top of the housing 15. This passageway is closed at its end by a block 26.

On top of this housing 15 and to the left of the central inlet member 22 is a spool valve assembly which includes a body 27 with a through bore 28. This bore is closed at its right end by a plate and resilient bumper 30 and 31. The left end of this valve body has the bore closed by a plate 32 which provides a stop for the leftward movement of a spindle 34. This spindle is shown as having a pair of shallow spaced grooves formed in and at its left end. These grooves are identified as 36 and 37 and are adapted to be engaged to establish the desired position of travel of the spindle and at said positions these grooves are selectively engaged by ball detents 38. These ball detents, as they engage the grooves in the spindle, prevent movement of the spindle 34 in other than in a controlled manner.

On this spindle and to the right of the grooves 36 and 37 are four seal rings 40, 41, 42 and 43 preferably carried in appropriately formed grooves. These rings are adapted to seal the bore 28 to prevent air leakage and while and as the spindle is at the two limits of movement. These rings provide barrier means so that pressurized air does not flow along the spindle and past a ring. For this reason the bore 28 in the spindly body 27 has a very smooth and precisely formed bore 28 with a smooth surface so that the seals are not unduly worn or damaged in this slide valve identified as 46.

Within the housing 15 and reciprocable therein is a central rod or shaft 50 which is slidable in the housing 15. In the end portions of this housing are formed counterbores 51 and 52 in which are mounted shields 53 and 54. These shields prevent unwanted flow or passage of air or moisture into the interior of the housing. This shaft 50 carries on its midportion adjustably mounted and secured disks 55 and 56. These disks are each adapted to engage and actuate pilot valves to be disclosed in FIGS. 3, 4, 5, 6A and 6B. The cycling of shaft 50 is assisted in maintaining its alignment during cycling by bearings 58 and 59 as seen in FIG. 1. These bearings are secured in the end walls of the housing 15 and are adjacent the shields 53 and 54. The length of the stroke or travel of the shaft 50 is established by the pilot valve and the placement and securing of the disks 55 and 56.

As depicted, the housing 15 is shown as carrying like pilot valves with the left valve identified as 61 and the right valve as 62. Also secured to the end walls of housing 15 are inner half cup-shaped (cast or drawn) diaphragm housing members which are substantially alike and for identification are numbered as 64 and 65. On each end of shaft or rod 50 is secured like flexible diaphragm members 67 and 68. The central portion of each diaphragm member is secured to said shaft by screw means which as shown are flat head cap screws 70. The central portion of the diaphragms are conventionally reinforced by inner and outer plate means 72 and 73. These reinforcements are shown as like configurations and in use prevent the diaphragm from tearing or otherwise becoming weakened or leaking.

Each diaphragm chamber has an outer housing half identified as 76 and 77. These outer chamber halves are secured to the inner diaphragm members 64 and 65 at their outer periphery. Bolts, cap screws and other means are conventionally used with gasket material or similar sealing means. As depicted, the outer housing halves are also cup shaped with the central portion extending outwardly. Conventionally, these housings are of like configuration for economy sake. For the purpose of illustration these outer halves have upper and lower one-way valve means 79 and 80. These valves may be ball valves or flapper valves and their placement or arrangement is merely a matter of design and use and as depicted are shown as upper and lower flapper valves for convenience and illustration. Both outer chamber halves have one-way valves with one valve permitting only inlet flow with no outflow and the other valve in the same chamber having no inflow and permitting only outflow.

The shaft 50 is carried and cycled in the bearings 58 and 59 and the disks 55 and 56 carried and secured on this shaft actuate the pilot valves 61 and 62. The left disk 55 actuates the left pilot valve 61 and the right disk 56 actuates the right pilot valve 62. These pilot valves cause pressurized air to flow to and from the slide valve 46. At the bottom of the housing is an air outlet 82 which allows excess pressurized air to escape. Each valve 61 and 62 is carried in a shouldered bore 84 and 85 formed in the housing 15. The inner half cup-shaped member on the inner diaphragm housing members 64 and 65 are each formed with air inlet holes from the outwardly facing portion of valves 61 and 62. These air passageway holes are identified as 87 and 88. As seen in later discussed FIGS., the inner diaphragm housing member halves 64 and 65 are secured to the housing 15 with a gasket 90 therebetween and through this gasket these holes 87 and 88 extend through the housing and inner halves so as to provide air passageways.

PILOT VALVE CONSTRUCTION AND ACTUATION AS IN FIGS. 3 THROUGH 6B

Figure 3:
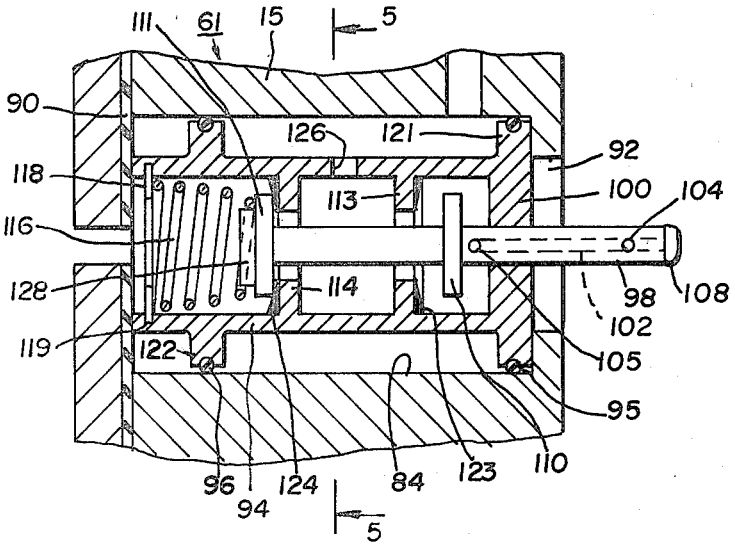
FIG. 3 represents, in an enlarged scale, a partly diagrammatic sectional view of a pilot valve that is actuated by a disk, this valve in its limits of movement controls the flow of pressurized air to and from the diaphragm chambers.
Figure 4:
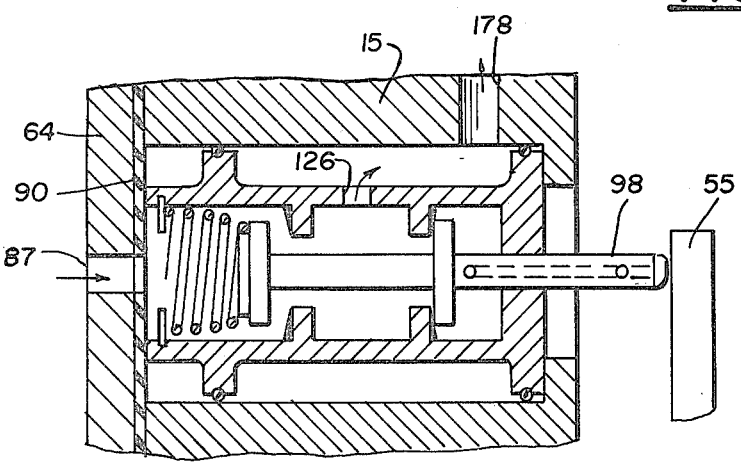
FIG. 4 represents a sectional side view of the valve of FIG. 3 as it is moved to the opposite condition of operation.

Pilot valves 61 and 62 are used with this dual action pump. IN FIGS. 3, 4, 5, 6A and 6B, there is disclosed a pilot valve construction that anticipates a removable mounting of the pilot valve in the housing 15. As depicted in FIGS. 3 and 4, the left pilot valve 61 has its shaft or shank directed toward the right which is the configuration used with the leftward end pump chamber. As depicted, this pilot valve is slidable in place in a shouldered bore 84 in the housing 15. A hole 92 is disposed in the inward wall of the bore 84. A body 94 having extending flange portions carries O-rings 95 and 96 to seal this body 94 within the cavity 84. A spool or shaft 98 is slidable in the right end wall 100 of the pilot valve body 94. This spool or shaft 98 includes an air hole or conduit 102 made as a longitudinally drilled hole from the distal end. Short, cross-drilled apertures 104 and 105 provide inner and outer passageways to the conduit 102. Since drilling into the shaft or spool 98 is made from the end, it is closed by an end member 108. This may be a self closure member of plastic such as Teflon or Nylon or may be of hardened steel. This closure member is, of course, replaceable. On this shaft 98 there is secured or formed disk members 110 and 111. Within the body 94 is internal disk or ribs 113 and 114 which are inserted and mounted as by solder, cement or the like. Of course, internal construction may be varied to provide spacers to dispose the disk confirmation 113 and 114 in a spaced relationship with an internal aperture provided on each disk so as to provide free movement of the pin 98 and pressurized air thereby. A compression spring 116 is retained in place by a snap ring 118 in a groove 119. Also shown in FIGS. 3 and 4 is a gasket of resilient material. The gasket identified as 90 is disposed between the body 15 and the end of the valve 61. The O-rings 95 and 96 are carried in outwardly extending frame portions 121 and 122 so as to provide an intermediate body member recess to the outer portion between the O-rings. A resilient rubber washer 123 is disposed to be contacted by the disk 110 when the pilot valve is moved to the left and a like resilient washer 124 is disposed to be engaged by the disk 111 when the spring 116 pushes the disk 111 into engaging position as seen in FIG. 3. A conducting passageway 126 is formed in the body 94 and between the internal inwardly disposed barriers 113 and 114. The left end of the shaft 98 may have a extending and enlarged portion 128 disposed to engage the reduced end of spring 116 so as to prevent dislodgement of the spring when the valve is actuated.

CROSS SECTIONAL VIEW AS SEEN IN FIG. 5

Figure 5:
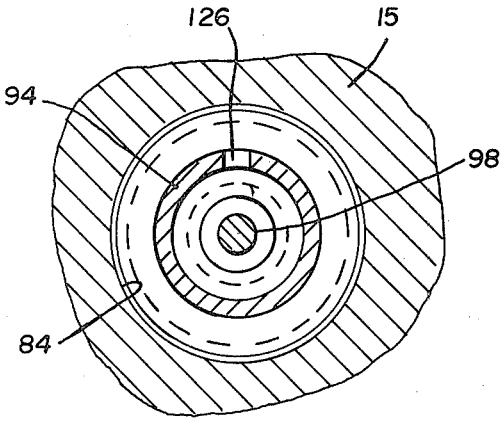
FIG. 5 represents a sectional side or transverse view as taken on the line 5—5 of FIG. 3 and looking in the direction of the arrows.

Referring next to FIG. 5, there is shown a cross sectional view of the pilot valve as seen in FIG. 3. This sectional view shows the conducting passageway 126 extending to the center portion of the valve body 94 and showing the shaft 98 in a sectional view. Housing 15 is seen holding the pilot valve in the bore 84.

ALTERNATE EMBODIMENTS OF VALVE BODY OF FIGS. 6A AND 6B

Figure 6A:
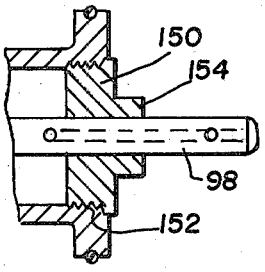
FIGS. 6A and 6B represent two methods for constructing the pilot valve so that the front movable disk and resilient washer may be positioned and retained in the valve body.

As seen in FIG. 6A, the valve body 94 has its front portion 150 made as a screw-in member. Threads 152 and enlarged shoulder 154 insures that this front portion is mounted into place after the resilient washer 123 has been secured and the disk 110 is also secured in place on the shaft 98. The bore for the shaft 98 is disposed to provide slidable bearing means so that the shaft 98 can be cycled back and forth as desired.

Figure 6B:
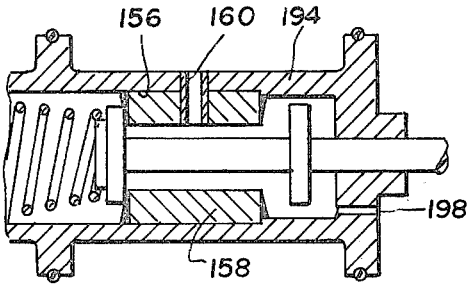

In FIG. 6B, it is contemplated that the valve body 194 can be made with a stepped recess 156 for mounting an internal spool member 158. In order to secure this internal spool member in place a hollow roll pin or the like identified as 160 is pressed into a conducting passageway 126 which is found in the housing 94 and extends through the internal member 158. This provides not only a securing of the spool in place but provides a positive air passageway into the interior of the pilot valve.

AIR AND DUAL PUMP ACTUATION AS SEEN IN FIGS. 1, 2, 7, 8, 9 and 10

Figure 7:
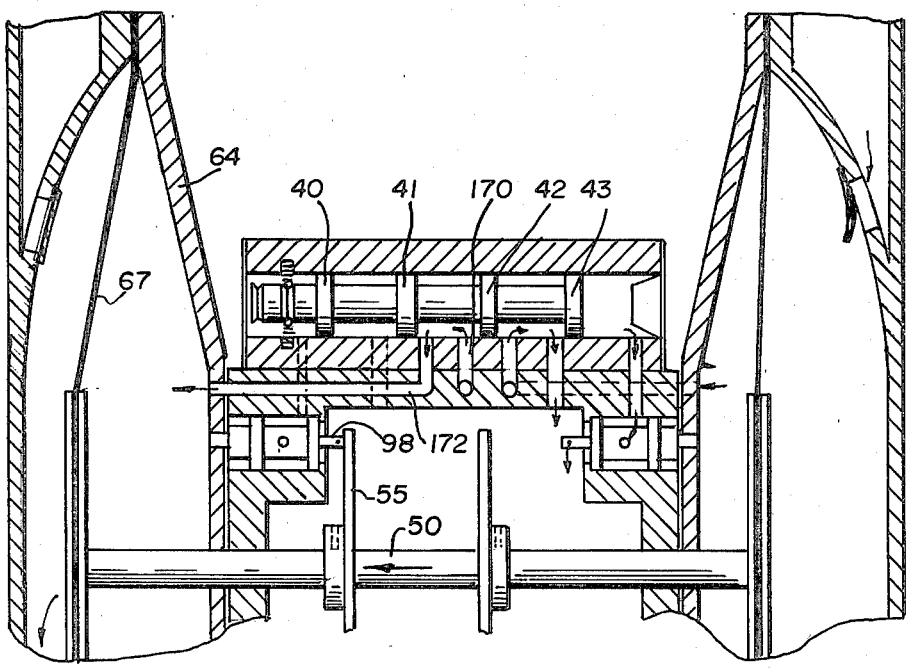
FIG. 7 represents a partly fragmentary and partly diagrammatic sectional view similar to FIG. 1 and showing the slide spool and pressurized air controlling means in one extent of operation and with the left of the two leftwardly moving disks carried by a central rod in engagement with and actuating the pilot control valve of FIG. 3.
Figure 8:
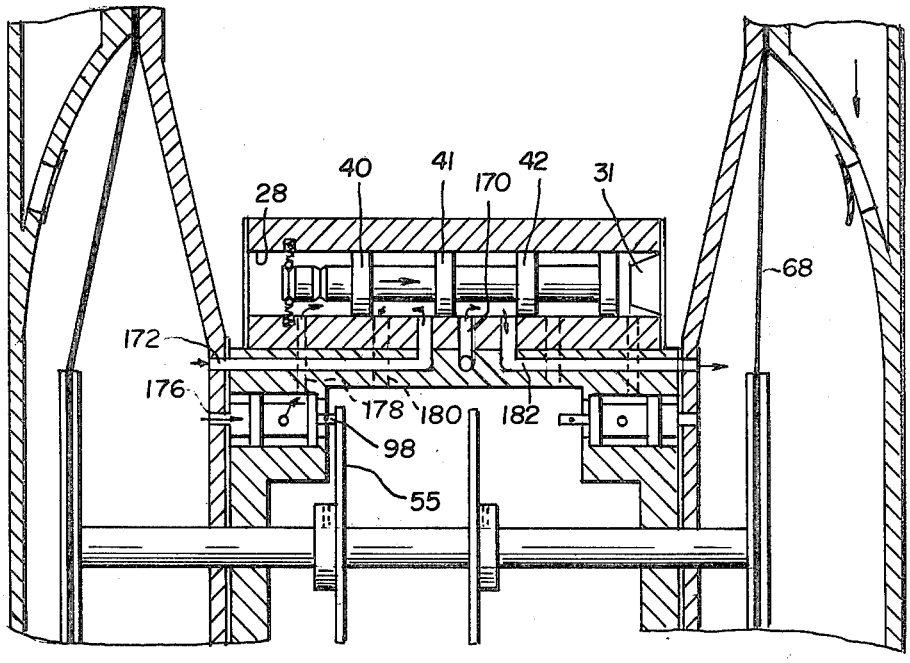
FIG. 8 represents the view and apparatus of FIG. 7 with the pilot valve and the left diaphragm of the pump at the extreme left and with the pilot valve now providing a positive pathway for removal of pressurized air from the left diaphragm chamber while pressurized air is caused to flow into the right diaphragm chamber.

FIGS. 1 and 7 are substantially alike but the fragmentary views of FIGS. 7 through 10 portray step-by-step actuations of the diaphragms, the spindle and the pilot valves and the air flow path therethrough. FIG. 2, while somewhat fragmentary and partly diagrammatic, shows an air conduitway to the central portion of the spindle and from the air inlet. As seen in FIG. 7, entering pressurized air from the inlet to and through the conduit 170 is indicated by the arrows. Air moves along the spindle 34 and between seals 41 and 42 and enters passageway 172 after which said air flows to the inner side of the inner diaphragm housing member (left) 64 as indicated by the arrows. With pressurized air in this chamber the diaphragm 67 is moved leftwardly (pumping) as indicated by the arrow on the rod or shaft 50. In FIG. 8, the left disk 55 engages the end of the rod or shaft 98 to urge the pilot valve from the condition of FIG. 3 to the condition of FIG. 4. At this position the disk 110 has engaged the resilient face of member 123 to close the passage of air into housing 15 and air in the chamber to the right of the diaphragm 67 is free to and does enter the aperture 176 and thence past the spring 116, past the disk 111, and into the interior of the valve between the internal disk or rib portions 113 and 114. The air then flows from the passageway 126 to and through the passageway 178 into the left portion of the spindle 34. Seal ring 40 prevents pressurized air from escaping to the right past said seal ring and urges the spindle rightwardly (as seen by the arrow). The spindle 34, in its rightward movement, moves from its leftward position to its rightward position whereupon the ball detents 38 in the shallow groove 37 are displaced therefrom and these same ball detents enter the shallow groove 36. Air from the rightward movement of the diaphragm 67 also causes air to flow through passageway 172 to the spindle 34 and in the space between the rings 40 and 41 to flow from the reduced portion to conduit 180 and into the interior of the housing 15, thence out air outlet 82.

With the shifting of the spindle 34 to its condition of FIG. 8, air from conduit 170 flows into that reduced portion in the spindle between seals 41 and 42 and into conduit 182 and then to the inner side of the diaphragm 68 within the right chamber. This pressurized air causes the right diaphragm to move to the right and carries the shaft 50 therealong and to the right. The end of the spindle may engage or at least is stopped by the rubber bumper 31 which is secured to the end plate and at the right end of bore 28.

Figure 9:
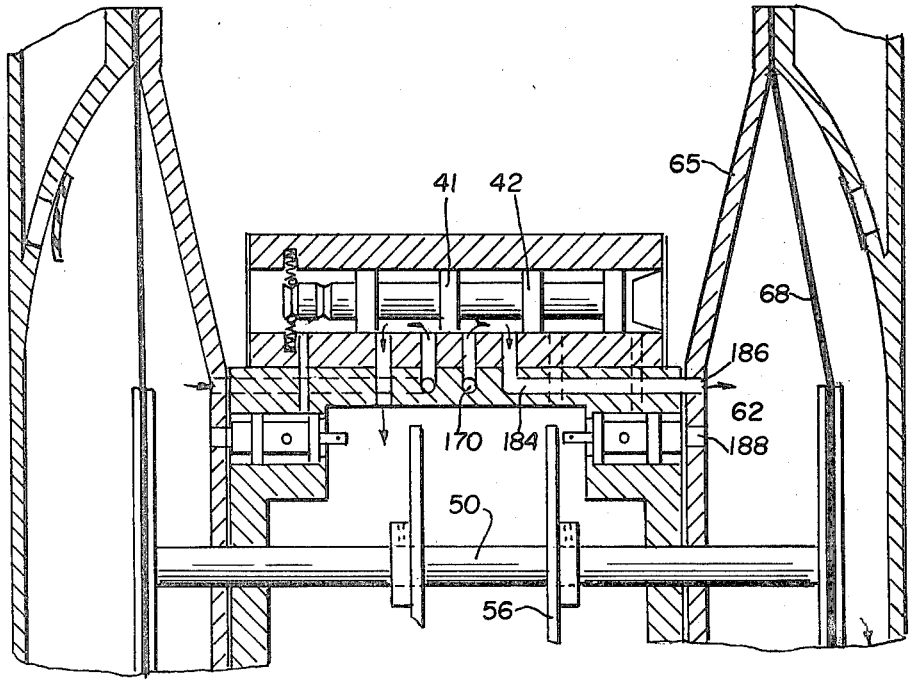
FIG. 9 represents the sectional view and apparatus of FIG. 7 with the central shaft and mounted disks moving to the right to cause air to flow behind the right diaphragm and to an expelling condition.
Figure 10:
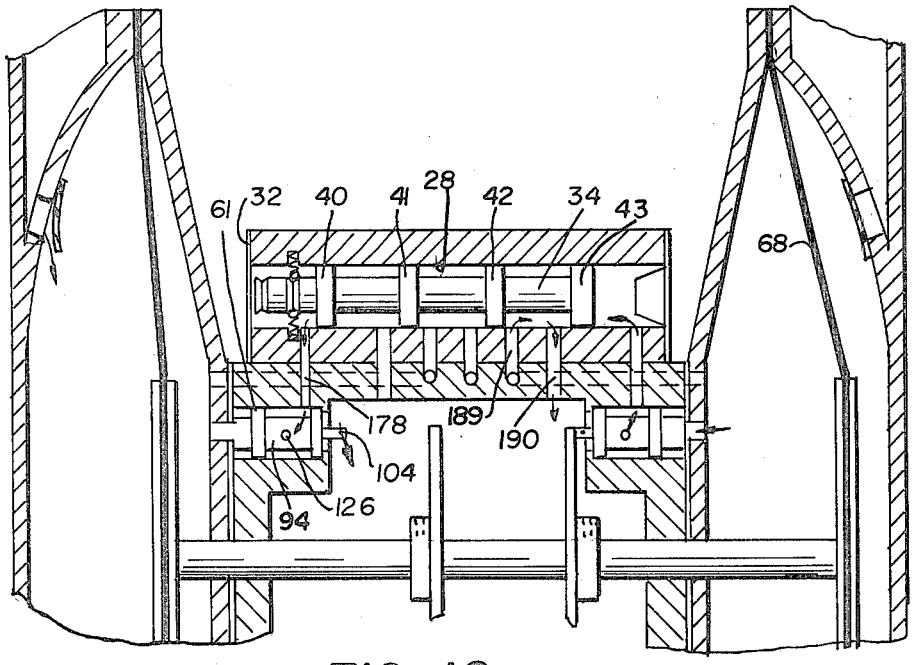
FIG. 10 represents the view and apparatus of FIG. 9 with the pilot valve and slide valve now moved so that pressurized air is being withdrawn from the right diaphragm chamber and pressurized air is once again being fed into the space behind the diaphragm in the left chamber.

In FIG. 9, it is to be noted that the shaft 50 and the right diaphragm 68 have moved to their expelling or pumping extreme and the pressurized air from conduit 170, which is carried in the conduit 184, is the pressurized air flowing between the seals 41 and 42. The right hand pilot valve, generally identified as 62, is like the pilot valve shown and discussed in FIGS. 3, 4, 5, 6A and 6B above, and of course, is turned 180 degrees. The disk 56, as shown in FIG. 9, has approached but actually has not engaged the pilot valve 62 so that the rear of the pilot valve (FIG. 3) is still closed by the disk 111 and resilient washer 124 to any flow of air through this valve. The inner diaphragm housing member 65 and the gasket used therewith has an aperture 186 which is in line with the connecting conduit 184 so that pressurized air enters behind right diaphragm 68. After the expelling (pumping) action has been completed the disk 56 engages the end of the shaft 98 as in FIG. 4. The air behind diaphragm 68 is now moved in and through the pilot valve as in FIG. 10. The spindle 34 is moved rightwardly when pressurized air, as indicated by the arrows, flows into the through bore 28 and engages seal ring 43. This pressurized air causes the spindle 34 to move to the right. The ball detents 38 again enter the shallow groove 37. The air in conduit 184 is caused to flow through the short passageway 189 and to the spindle 34 and into the reduced area between the seals 42 and 43. The air in that reduced area is caused to flow through short passageway 190 and into the body of the housing 15 and out the outlet 82 at the bottom of the housing. As seen in this FIG. 10, the left hand pilot valve 61, as the spindle is moved leftwardly, removes the air trapped between seal ring 40 and end plate 32. This air flows through passageway 178 to the valve body 94 thence through passageway 126 and past disk 110, then to and through aperture 105, conduit 102, and out the transverse drilled aperture 104 and into the housing 15. A like action is provided in the right hand valve 62 when the spindle 34 is moved to the right during an expelling (pumping) action.

As seen in FIGS. 3 and 4, the pilot valve is an assembly mounted in a shouldered bore 84 and retained by the gasket 90 and the end member 64. This end member is secured to an end of the housing 15. This pilot valve may be made in many ways, but an economical configuration is shown in FIG. 6B wherein the body 94 is made as one piece with a central bore for the shaft 98 and a fore part of this body extends to the face of the boss in the housing 15 so as to provide the maximum bearing guide and support for the shaft 98. The central sleeve portion 158 may be made of resilient material or a rubber-like material so as to provide front and rear resilient faces 123 and 124. These face portions may also added on or may be included as a portion of this member. This tubular member is secured and held in place by means of a hollow pin and the shoulder establishes the positioning of this member within the bore. Whether the drill hole for the hollow roll pin 160 is made at the time of assembly or prior to use in merely a matter of preference. Separate pins may be used to retain this auxilliary sleeve or other means may be provided. A disk 110 is secured to the shaft 98 after the member 200 has been secured in place. The disks 55 and 56 insure that the pumping action and expelling action on both diaphragms are selective and positive. The positioning of a disk allows one diaphragm to be moved to provide a shallow or extended actuation to provide differential pumping if desired.

The above drawings are more-or-less diagrammatic to show and explain the actuation of the dual diaphragm pump and particularly the spindle 34 as moved in the smooth bore of the block 26. The ball detents and the shallow grooves on the spindle 34 insure that said spindle is at one limit or the other so that the air passageway and the pilot valves move in a controlled program to automatically move the diaphragms and the cycled disks on the shaft in response to pressurized air.

There are many ways to construct the dual pump assembly including a making of the pilot valve body assembly of either plastic or metal and mounting this pilot valve body in a counterbored hole in a boss portion of the housing 15. This boss portion may be made as a removable and replaceable member that is secured to either one of the walls or an end member of the housing 15, or to the removable inner member 64 or 65 for the diaphragm pump. A compression spring 116 is depicted for providing the bias to move the shaft 98 of the pilot valve away from the diaphragm, but a resilient bias member may be provided if desired. Resilient ring face portions 123 and 124 are shown as provided on the internal rib portions 113 and 114 but resiliency may be provided instead on the disk faces 110 and 111 in order to provide the desired closure or shut-off of the air passageway. It is to be noted that the shaft 98 may be cycled in the housing between the two rib portions 113 and 114 with an air passageway as a drilled hole formed in each of the ribs in order to provide an air conduit to the passageway 126. The gasket 90, shown as a separate member, may be gasket cement or the like as long as the housing 15 is secured to the inner chamber in an air tight manner. Although the housing member for both the inner and outer portion of the pump and retention of the diaphragm is contemplated to be similar or alike, this does not preclude the making of the housings and the diaphragms in different configurations and sizes. The air hole or conduit 102 is normally carried in and by the shaft 98 but this also does not preclude the forming of a small aperture 198 in the forward wall of the pilot valve in which the shaft may be reciprocably moved. This aperture provides the needed or desired air conduit. Seals 40, 41, 42 and 43 as above described are contemplated to be O-rings, but seals may be provided by other types or styles such as chevron rings. The extending rib portions of the spindle 34 may be made as a more-or-less or have a line fit and a small amount of lubrication may be provided to prevent or limit the passage of air along the bore 28. The spindle 34 is shown with two grooves 36 and 37 establishing the two limits of movement and ball detents 38 engage these grooves to limit the travel of the spindle. A rubber bumper 31 is also provided to prevent over travel of the spindle when moved to the right as seen in FIG. 1. Other forms of limitation may be provided to prevent free travel of the spindle within this bore.

The above described pump is actuated by air or hydraulic or similar means. It is to be noted that an electrical connection to a solenoid means for moving the spindle is not provided since electric circuitry may be potentially dangerous and an increased expense. The above dual diaphragm pump allows and encourages the adjusting of the pump to provide a desired output from each diaphragm. The size of inlet and outlet, the style and types of valve and the applied or conducted pressure of air and the flow of air to the spindle 34 and to the pilot valves is determined largely by the pumping action to be provided by this apparatus.

It is to be noted that the term "pressurized fluid" usually refers to air but this does not preclude the use of other gasses such as nitrogen. Hydraulic fluid which includes water may also be provided. The showing of one-way valves of the flapper construction is shown in applicant's U.S. patent application Ser. No. 188,325 filed Sept. 18, 1980, but this does not imply that the double diaphragm pump need to employ such means since one-way valves are well known. The disks 55 and 56 are shown since they are easy to use and position but arms of any desired configuration may be provided as long as the positioned and secured arms are disposed to engage the end of the shaft 98 of the pilot valve as above depicted. The construction of the pilot valves 61 and 62 may be altered but the providing of a flow path from the diaphragm chamber, and the cut-off of pressurized flow by means until actuation by an arm member after which pressurized fluid is caused to flow through the pilot valve to the spindle bore 28 to move the spindle 34 while venting other portions of the moving spindle is believed to be novel.

Although the housing 15 is shown with front and rear access covers 16 and 18, this is not to preclude the making of a housing with the inner diaphragm housing members 67 and 68 providing the end closures and with the bosses for housing the pilot valves 61 and 62 secured to these same diaphragm housings. The ball detents 38 and the shallow grooves 36 and 37 in the spindle 34 are shown in the extending portion to the left of the first seal ring 40 but it is also contemplated that groove means could be provided at and with the extending land of one or two seal portions. Means other than ball detents and grooves may also be provided but the disclosed arrangement is an effective and inexpensive means for establishing limits of spindle movement.

The pressurized fluid passageways 172 and 184 from the through bore 28 are shown in FIG. 2 as parallel but offset from each other. This is merely a matter of selection and preference since the passageways may be drilled in the walls of the housing or may be tubing disposed to suit selected conditions. The selection of materials and positioning is determined by the service to which the pump is to be placed. For this reason the above embodiments are substantially diagrammatic and illustrative of the operation.

Terms such as "left", "right", "up", "down", "bottom", "top", "front", "back", "in", "out" and the like are applicable to the embodiment and alternate embodiments shown and described in conjunction with the drawings. These terms are merely for the purposes of description and do not necessarily apply to the position in which the dual diaphragm pump may be constructed or used.

While a particular embodiment of the dual pump and alternate embodiments have been shown and described it is to be understood the invention is not limited thereto and protection is sought to the broadest extent the prior art allows.

What is claimed is:

1. A double-acting, pressurized fluid-actuated double diaphragm pump for fluids and the like, said pump including:

(a) a main pump housing support adapted for mounting to a support means;

(b) a first pump housing means attachable to said main pump housing support, the first housing means including inner and outer diaphragm housing members with the outer members having inlet and outlet valve means providing one-way flow control of the pumped fluid;

(c) a first diaphragm interposed between said inner and outer housing members and means for securing the diaphragm at its outer periphery in a fluid tight manner;

(d) a second pump housing means attachable to said main pump housing support, said second housing means including inner and outer diaphragm housing members with the outer member having inlet and outlet valve means providing one-way flow control of the pumped fluid;

(e) a second diaphragm interposed between the inner and outer diaphragm housing members and means for securing said second diaphragm at its outer periphery in a fluid tight manner;

(f) a reciprocable rod connecting the central portion of the first and second diaphragms and as one diaphragm is moved outwardly to provide an expelling actuation the other diaphragm is moved inwardly to provide an intake actuation, said rod secured at its ends to central portions of the diaphragms and with the rod carried in and by bearing means provided in the main pump housing;

(g) a pressurized fluid inlet connecting means adapted to receive the pressurized fluid from an external source and deliver said fluid to a control system including conduit means;

(h) a slide valve associated with the main pump housing and including a housing and a spindle reciprocable to two limits of movement in a finished bore of regular diameter formed in said housing, said spindle having reduced diameter areas interposed between four seal ring areas, each ring area adapted to restrict flow of pressurized fluid along said bore;

(i) means for sealing the ends of the finished bore so that pressurized fluid does not escape from said bore as the spindle is moved therein;

(j) a pair of arm member means carried on and movably secured to the reciprocable rod as it is cycled;

(k) a pair of pilot valves each carried in a bore in a boss portion provided within the main pump housing, each of said pilot valves arranges as a mirror pair and having a shaft within said pilot valve and with an extending end disposed to be engaged and moved by an arm member means, each of said valves having a bias means adapted to urge the shaft toward the central portion of the main housing, said pilot valves additionally having a pair of spaced disk portions adapted to alternately engage rib portions disposed between inwardly facing portions carried by the shaft of the pilot valve and with these disk portions adapted to be alternately brought into engagement with the rib faces so as to shut off fluid flow to and from the interior of the pilot valve and with each pilot valve providing conduit means disposed between the ribs;

(l) a conduit from the inner side of the diaphragm chamber and to a position adjacent the inlet of pressurized fluid from the source and to the spindle reduced area;

(m) a conduit from the diaphragm chamber and through the pilot valve and to the conduit means between the ribs of a pilot valve, and (n) a discharge conduit from the main pump housing, whereby pressurized fluid is fed to the inlet thence to the reduced area of the spindle intermediate its ends and between the second and third seal ring areas and with the spindle at its left position the pressurized fluid between the second and third seal ring areas flows therefrom to the inner side of the first diaphragm to provide a pumping actuation, and the first pilot valve is closed to pressurized fluid flow from the first diaphragm chamber and pressurized fluid flows from the reduced area of the spindle between the third and fourth seals and exterior of the fourth seal to and through the second pilot valve and from this pilot valve to and through the discharge conduit in the main pump housing, and when the first pilot valve is actuated by the first arm member pressurized fluid flow is reversed as to the first pilot valve and pressurized fluid from the diaphragm chamber and the first pilot valve is caused to flow into the closed bore exterior of the first seal to move the spindle to the other limit of motion to uncover a passageway to the second diaphragm and pressurized fluid enters the second diaphragm chamber and moves the diaphragm to a pumping actuation and this actuation is reciprocably and alternately made in response to actuations of the pilot valves and their actuation by said arm members.

2. A double-acting diaphragm pump as in claim 1 in which the first and second diaphragms are reinforced at their central attachment portion with inner and outer plate means with the attachment of each diaphragm to the reciprocable rod being by a cap screw secured in and to a threaded hole in the end of the rod.

3. A double-acting diaphragm pump as in claim 1 in which the arm members are disks of metal.

4. A double-acting diaphragm pump as in claim 1 in which means for moving the shaft of the pilot valve is a compression spring.

5. A double-acting diaphragm pump as in claim 1 in which the main pump housing has four connected side members with end access covers which are removably secured to the housing to provide an enclosure.

6. A double-acting diaphragm pump as in claim 5 in which the discharge conduit is formed in and through the bottom of the main housing.

7. A double-acting diaphragm pump as in claim 1 in which the exterior diaphragm members are substantially alike and one-way valve means for both incomming and expelling flow are carried in this exterior member.

8. A double-acting diaphragm pump as in claim 7 in which one-way valves are leaf-type valves disposed to cover port apertures, the leaf-type portion being urged away from the apertures by fluid flow.

9. A double-acting diaphragm pump as in claim 1 in which the reciprocable rod is carried by two spaced apart bearings and at least two seals, each bearing and seal disposed in a recess formed in an end portion of the main pump housing and providing therewith support means for axial movement and sealing of the chamber interior of the diaphragm and exterior of the main pump housing.

10. A double-acting diaphragm pump as in claim 9 in which the seal is a chevron packing and an O-ring.

11. A double-acting diaphragm pump as in claim 1 in which the pilot valves are each carried in shouldered bores in boss portions provided in the main pump housing.

12. A double-acting diaphragm pump as in claim 11 in which the shaft of the pilot valve is made with a conducting passageway in the fore portion of the shaft, said passageway providing means for transferring pressurized fluid from inside the pilot valve to the interior of the main pump housing.

13. A double-acting diaphragm pump as in claim 11 in which the face portion of the pilot valve housing has a passageway therethrough, said passageway providing means for conducting pressurized fluid from inside the pilot valve to the interior of the main pump housing.

14. A double-acting diaphragm pump as in claim 1 in which the pressurized inlet connection is a block secured to the main housing and having a conduit from a threaded inlet to a connecting means to the inlet to the slide valve intermediate its ends and between intermediate seals on the spindle.

15. A double-acting diaphragm pump as in claim 14 in which the seals on the spindle are O-rings carried in grooves formed in outward rib portions provided on the spindle.

16. A double-acting diaphragm pump as in claim 14 in which the spindle has two stop limits established on the spindle and exterior of a first seal.

17. A double-acting diaphragm pump as in claim 16 in which the stop limits on the spindle are shallow grooves and cooperatively and alternately engage one or the other of these grooves with ball detents carried by a housing in which the bore is formed.

18. A double-acting diaphragm pump as in claim 1 in which the pilot valve includes a body having outwardly extending portions into which grooves are provided and O-rings are placed to provide sealing means inhibiting the flow of pressurized fluid.

19. A double-acting diaphragm pump as in claim 18 in which the pilot valve body includes a face portion which is screwed in position to provide mounting in the body.

20. A double-acting diaphragm pump as in claim 18 in which the disk portions on the shaft of the pilot valve are brought in way of resilient washer portions carried on and secured to inwardly disposed portions of the valve body.

21. A double-acting diaphragm pump as in claim 18 in which the pilot valve is made with a body in which a finished recess is provided and in this recess is mounted an internal spool member disposed to provide exterior face portions that are alternately engaged by the disk portions on the pilot valve shaft.

22. A double-acting diaphragm pump as in claim 21 in which the spool member is made with resilient face portions and the spool member is retained in place with at least one pin.

* * * * *